United States Patent [19]

Loyd

[11] 4,404,706

[45] Sep. 20, 1983

[54] PORTABLE AIR BLOWER SWEEPER APPARATUS

[75] Inventor: Ronald C. Loyd, Keithville, La.

[73] Assignee: Emerson Electric Co., St. Louis, Mo.

[21] Appl. No.: 309,433

[22] Filed: Oct. 7, 1981

[51] Int. Cl.[3] ..... A47L 5/14

[52] U.S. Cl. ..... 15/344; 15/405; 15/410; 173/163; 415/121 R; 417/234

[58] Field of Search ..... 15/405, 344, 410; 415/121 R; 417/234; 173/163

[56] References Cited

U.S. PATENT DOCUMENTS 4,187,577 2/1980 Hansen et al. ..... 15/405 X 4,286,675 9/1981 Tuggle ..... 173/163

*Primary Examiner*—Chris K. Moore

*Attorney, Agent, or Firm*—Hubbard, Thurman, Turner & Tucker

[57] ABSTRACT

A centrifugal air blower unit includes a casing comprising two separable sections which enclose a centrifugal impeller. The impeller has a hub including a threaded bore for attaching the impeller to the distal end of a drive shaft extending from a support of a portable power unit. The casing is adapted to mount on a support housing for the drive shaft. The hub of the impeller includes a portion extending in a direction opposite to the threaded portion and through an opening in the bottom wall of the casing whereby the impeller may be threaded onto and off of the drive shaft for connecting and disconnecting the blower unit to the bearing housing without disassembly of the casing. The casing includes a mounting pad formed integral with one of the casing parts and supported by a plurality of spaced apart radially projecting webs forming an air inlet opening and also forming combination inlet guide vanes and a trash guard for the impeller.

16 Claims, 7 Drawing Figures

PORTABLE AIR BLOWER SWEEPER APPARATUS

BACKGROUND OF THE INVENTION

1. Field of the Invention

The present invention pertains to a portable air blower sweeper apparatus particularly adapted for use in combination with a lightweight hand held power supply unit having an elongated power takeoff shaft disposed within a support tube for the takeoff shaft and the air blower unit.

2. Background Art

There have been various devices developed in recent years for producing a high volume flow stream of air for use in sweeping and dusting operations, particularly for sweeping outdoor surfaces such as driveways, sidewalks, patio decks and other surfaces which can be easily cleaned with a directed air stream. Devices have been developed which are specifically used for air blowing and sweeping operations only and comprise an integral power unit or motor directly coupled to an impeller disposed in a casing or shroud and having an outlet nozzle. Although a wide variety of air blower sweepers have become available which are designed for one specific purpose only, it has become desirable to provide an air blower unit which is readily adaptable to a lightweight hand held power supply unit of the type which is also usable with various other attachments such as flexible line trimmers, edgers, snowthrowers and other lawn or garden equipment.

One improved and commercially successful power supply unit is of a type disclosed and claimed in U.S. patent application Ser. No. 051,950 filed June 25, 1979 and now U.S. Pat. No. 4,286,675, Sept. 1, 1981, which is assigned to the assignee of the present invention. The aforementioned power supply unit comprises a lightweight hand held internal combustion engine having a power takeoff shaft which may be coupled to an extension power takeoff shaft disposed within an elongated support tube. The distal end of the support tube is adapted to be connected to various attachments, including flexible line trimmers and brush cutters. The much improved balance and handling characteristics of the aforementioned power supply unit has also made it attractive for a power source for a portable air blower sweeper which could benefit from the improved handling characteristics and other advantages of the power supply unit.

Moreover, there has also been a need for an air blower unit which is easily attached to flexible line trimmers of the type having a rotary head which may be detached from the distal end of an elongated support tube and replaced by another attachment. Accordingly, there has been a particular need for an air blower unit which may be easily connected to the distal end of a power takeoff shaft supported at one end of the bearing or support tube for a flexible type power takeoff shaft and without requiring the complete disassembly of the air blower unit prior to reassembly on the end of the aforementioned support tube. The present invention meets the requirements and desiderata of an air blower unit particularly adapted for use with the improved power supply unit disclosed and claimed in the aforementioned patent application, but which also has features making it attractive for use with other powered lawn and garden implements.

SUMMARY OF THE INVENTION

The present invention provides an improved air blower sweeper apparatus which is particularly adapted for use in combination with a lightweight hand held portable power unit which is attached to the air blower by means of an elongated support tube which supports therein an elongated drive shaft interconnecting the power takeoff shaft of the power unit and a centrifugal impeller disposed in a shroud or casing having a generally horizontally disposed discharge nozzle. In particular, the air blower unit of the present invention is adapted to be mounted on the distal end of an elongated support tube which is also adapted to support a rotary head for a flexible line trimmer, brush cutter or the like.

In addition to the advantageous features of the air blower unit of the present invention, which make it particularly attractive in combination with the improved power supply unit, the air blower unit is also of an improved construction which provides for easy assembly and disassembly with respect to a bearing housing mounted on the distal end of the aforementioned support tube whereby the air blower unit may be readily interchanged with other types of attachments or implements which are also adapted to be removably mounted on the bearing housing. An important aspect of the present invention is provided by an air blower unit having an impeller which is mounted within a casing providing a collector and discharge flow path for the air displaced by the impeller and wherein the impeller and casing assembly may be removably mounted on the aforementioned bearing housing without disassembly of the air blower unit itself. The impeller is provided with a hub having a portion which is threadedly engageable with the distal end of a power takeoff shaft which supports the hub in cantilever fashion within the casing. The impeller hub is provided with means extending through a bottom wall of the casing and which may be gripped manually or by a suitable tool for connecting and disconnecting the impeller with respect to the power takeoff shaft without disassembly of the impeller casing.

In accordance with another aspect of the present invention, there is provided a compact and economical air blower unit which is characterized by only three separate parts, all of which may be conveniently fabricated of molded plastic or the like, and which provide an efficient and reliable air blower unit particularly useful for sweeping large generally horizontally disposed surfaces. In particular, the air blower unit of the present invention is provided with a casing which is split in a plane perpendicular to the axis of rotation of the centrifugal impeller of the blower unit and wherein one casing part includes a mounting pad for attaching the blower unit to a bearing housing of an elongated support tube for a portable power unit. The aforementioned casing part also includes a somewhat annular air inlet opening having a plurality of generally radially projecting guide vanes which also form a guard for minimizing the ingestion of foreign objects into the blower impeller. The aforementioned casing part may be adapted to be used in combination with an open sided impeller facing the air inlet opening in the housing or an open sided impeller having a support plate facing the air inlet opening but also provided with an annular inlet opening between the impeller hub and the inner periphery of the support plate.

The superior features and advantages of the air blower unit of the present invention will be further appreciated upon reading the detailed description which follows in conjunction with the drawings.

DESCRIPTION OF THE PREFERRED EMBODIMENTS

Figure 1:
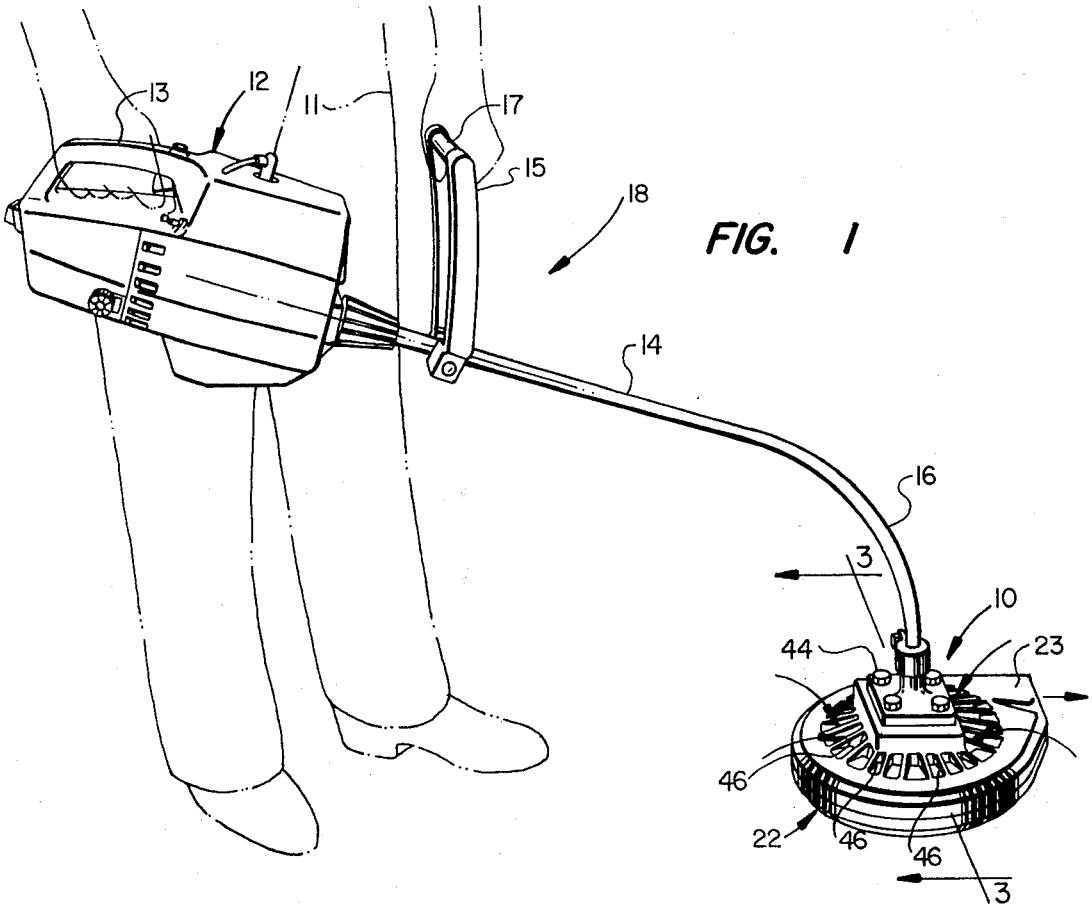
FIG. 1 is a perspective view of the air blower unit of the present invention illustrated in combination with a preferred portable power unit and disposed in the normal working position.

In the description which follows, like parts are indicated throughout the specification with the same reference numerals, respectively. The drawings are not necessarily to scale and certain parts and positional relationships have been exaggerated in scale to better illustrate the features of the present invention.

Referring to FIG. 1, the air blower unit of the present invention, generally designated by the numeral 10, is illustrated in combination with a portable power supply unit 12 comprising a lightweight internal combustion engine of improved design as disclosed and claimed in the aforementioned U.S. patent application, Ser. No. 051,950; filed: June 25, 1979, which is incorporated herein by reference. The power unit 12 includes a power takeoff shaft portion, not shown, which is connected to an elongated flexible drive shaft disposed within and rotatably supported by an elongated support tube 14. The support tube 14 includes a curved portion 16 which provides for disposing the output end of the drive shaft in a generally vertically extending direction when the power unit 12 is held in a normal working position as illustrated. The blower unit 10 is particularly adapted for use in combination with the power unit 12 and the support tube 14 to provide a balanced and easily handled apparatus which is generally designated by the numeral 18. The blower apparatus 18 is particularly suited for easy maneuvering and operation thanks to the general arrangement of the power unit 12 and, particularly, the centrally disposed longitudinally extending handle portion 13 and an adjustable transverse handle, generally designated by the numeral 15, the position of which may be adjusted with respect to the support tube 14. The handle 15 includes a transverse handle bar 17 which may be gripped by one hand of an operator 11 while the other hand of the operator grasps the handle 13. The power unit 12 includes a digitally actuated throttle level disposed within the handle 13 and adapted to be easily grasped by the hand of the operator which is gripping the handle 13.

Figure 2:
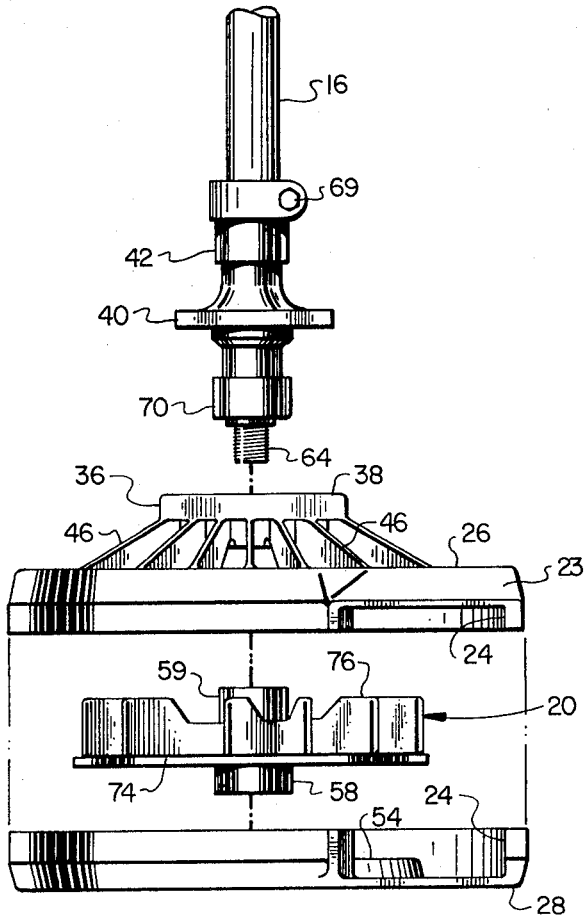
FIG. 2 is a side elevation exploded view of the air blower unit taken from the same direction as the view of FIG. 3.

Referring also to FIG. 2, the blower unit 10 is characterized by a centrifugal impeller 20 which is adapted to be disposed in a casing 22. The casing 22 is split into separable parts along a line in a plane perpendicular to the axis of rotation of the impeller 20. The casing 22 includes an air discharge nozzle 23 having an opening 24 of a generally rectangular configuration and disposed to direct a relatively large volume, high velocity air stream in a generally horizontal direction when the blower unit is positioned in an attitude as indicated in FIG. 1. The casing 22 comprises separable parts 26 and 28 which are adapted to be fastened together with a plurality of threaded fasteners 30, one shown in FIG. 3. The casing parts 26 and 28 are particularly adapted to be formed as molded plastic or lightweight metal parts.

Figure 3:
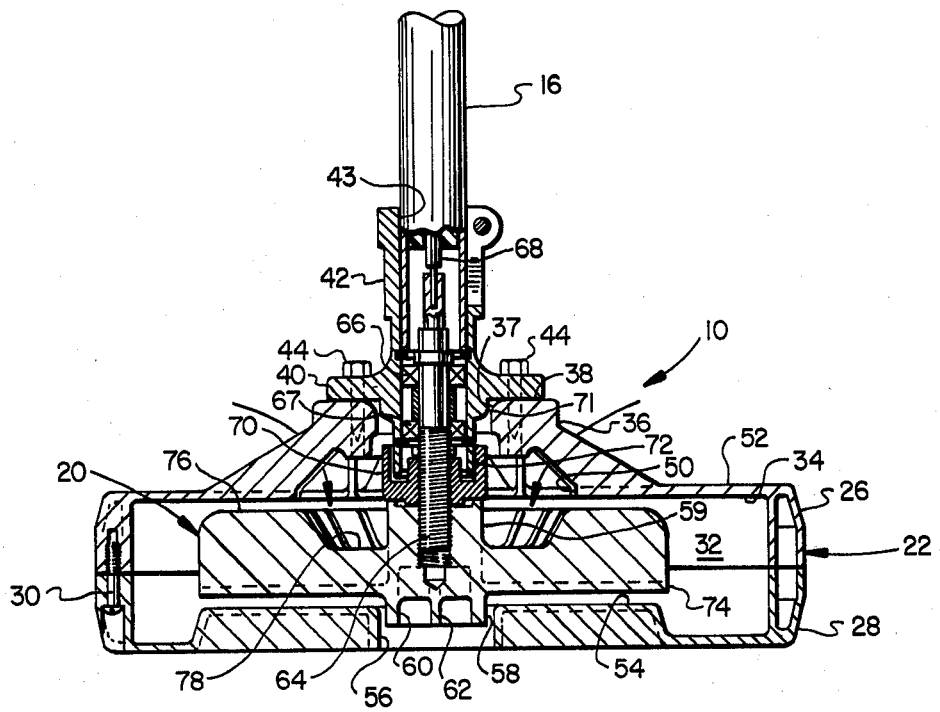
FIG. 3 is a section view taken substantially along the line 3—3 of FIG. 1.

Referring also to FIG. 3, the casing parts 26 and 28, when assembled as shown in FIG. 3, form a generally annular air flow passage 32 for collecting the air flowing radially outward from the impeller 20 and directing the air flow to the discharge opening 24. The configuration of the flow passage 32 may have a generally spiral cross-sectional shape for receiving the impeller discharge flow directly. Since the air blower unit 10 is intended for relatively low pressure, high flow velocities, a typical diffuser section is not necessary. The casing part 26 includes an interior recess 34 forming a portion of the passage 32 and is also provided with an integrally formed mounting pad 36 having a face 38 adapted to be engaged with a flange 40 of a bearing housing 42 removably connectable to the distal end of the support tube 14.

The blower unit 10 is adapted to be connected to the bearing housing 42 by a plurality of threaded fasteners 44 which extend through suitable holes in the mounting flange 40 into the mounting pad 36 as indicated in FIGS. 1 and 3. The fasteners 44 may typically be of the self tapping type. The mounting pad 36 of the blower unit 10 is supported by a plurality of spaced apart and generally radially extending web portions 46 which not only function to support the mounting pad with respect to the remainder of the casing part 26, but also serve as inlet guide vanes for admitting air flow into an inlet opening 50 formed in the top wall 52 of the casing part 26. The webs 46 also form a guard to prevent the ingestion of large objects into the inlet opening 50, which objects would likely damage the impeller 20 during rotation thereof.

The casing part 28 includes a recessed bottom wall portion 54 which is dimensioned to be positioned closely adjacent the backside of the impeller 20 to minimize leakage flow from the passage 32 through a central circular opening 56. The opening 56 is provided to receive a portion 58 of the hub of the impeller 20 which hub portion includes a recess 60 having a central transverse web 62 whereby the impeller may be grasped manually or by a suitable tool for threading the impeller onto and off of the distal end of a drive shaft 64. The drive shaft 64 is rotatably mounted in spaced apart bearings 66 and 67 disposed within a central bore within the housing 42 and suitably retained therein by conventional means. The drive shaft 64 is also provided at its opposite end with a socket for receiving a cooperating drive tang of a flexible drive shaft 68 which is supported for rotation within the tube 14 and is drivably connected at its opposite end to the power takeoff shaft of the power unit 12. The drive shaft 64 is provided with suitable threads on its distal end which are adapted to be threadedly engaged with cooperating internal threads formed in the main portion of the hub 59 of the impeller 20. A combination spacer and dust seal 70 is positioned between the hub 59 and a tubular portion 72 of the bearing housing to prevent entry of foreign matter into the bearings 67 and 66.

Figure 4:
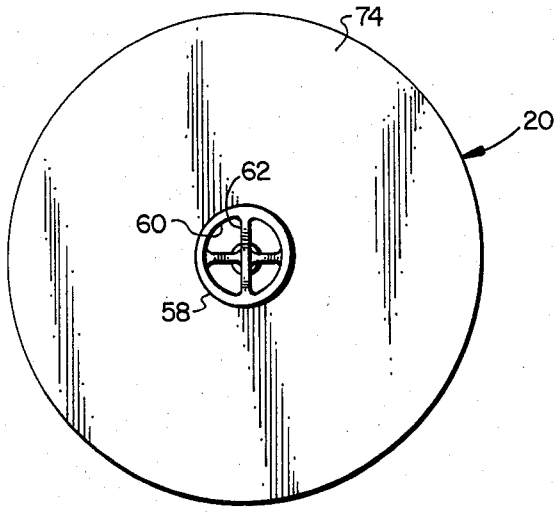
FIG. 4 is a plan view of one side of the impeller of the air blower unit illustrated in FIGS. 1 through 3.
Figure 5:
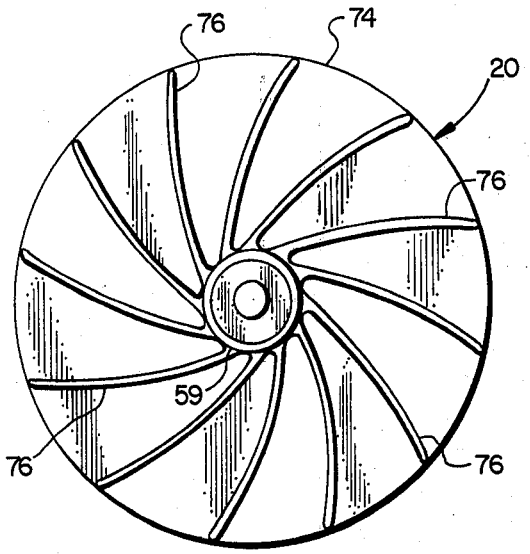
FIG. 5 is a plan view of the opposite side of the impeller shown in FIG. 4.

Referring also to FIGS. 4 and 5, the impeller 20 is of the open sided configuration having a support plate 74 formed on the backside thereof and adapted to provide support for a plurality of radially extending, forward curved impeller blades 76 extending from the hub 59 outwardly to the periphery of the support plate. As shown in FIG. 3, the blades 76 include portions 78 adjacent the hub 59 which are of reduced axial width to provide an inlet area for air flowing through the opening 50 which provides for turning of the air flow without inducing flow disturbances in the inlet flow stream. The forward curved blades 76 impart a greater exit velocity to the air leaving the periphery of the impeller 20, which is desired in a blower unit of the type where the kinetic energy of the moving air stream is utilized to perform sweeping operations and the like. The impeller 20 is mounted within the interior of the casing 22 in closely spaced relationship to the inner surfaces of the walls 52 and 54 to minimize the leakage air flow between adjacent channels formed between the blades 76 as well as between the backside of the support plate 74 and the inner surface of the wall 54.

Although the blower apparatus 18 may be provided as a complete unit including the power supply unit 12 and the support tube 14, there are many applications for the blower unit 10 wherein it is desirable to supply the unit as an accessory item to replace the head of a flexible line trimmer, brush cutter, or other tool used in connection with a power supply unit and support tube such as the type disclosed herein or similar types. Accordingly, the blower unit 10 may be provided as a separate assembled unit comprising the impeller 20 and the assembled casing parts 26 and 28. In order to facilitate easy assembly of the blower unit 10 as a replacement unit for a line trimmer head or the like, the line trimmer head would be removed from the housing 42 and the blower unit 10 conveniently assembled to the housing without disassembling the casing parts 26 and 28. By merely aligning the blower unit 10 with a pilot portion 71 on the bearing housing and inserting the bearing housing through a central pilot bore 37 formed in the mounting pad 36, the distal end of the shaft 64 may be engaged with the impeller 20 whereby the impeller may then be threaded onto the end of the shaft by grasping the web 62 manually or with a suitable tool such as a pair of pliers or the like. Accordingly, by merely threading the impeller on to the shaft 64, and then inserting the screws 44, the blower unit is conveniently attached to the bearing housing 42 and is ready for use with the power unit connected to the support tube 14. Of course, the blower unit 10 may also be supplied in combination with the bearing housing 42 and the drive shaft 64 as a complete assembled unit to be assembled with the power unit by inserting the lower end of the support tube 14 and its associated flexible drive shaft 68 into the bore 43 formed in the bearing housing. The upper end of the bearing housing 42 is provided with a conventional axial slot formed between radially projecting bosses which are adapted to be drawn together by a bolt 69, as shown in FIG. 2, to clamp the bearing housing to the support tube 14. Moreover, if it is necessary to repair or replace the impeller 20 the casing 22 may, of course, be disassembled by removing the screws 30 to separate the casing part 28 from the part 26.

Figure 6:
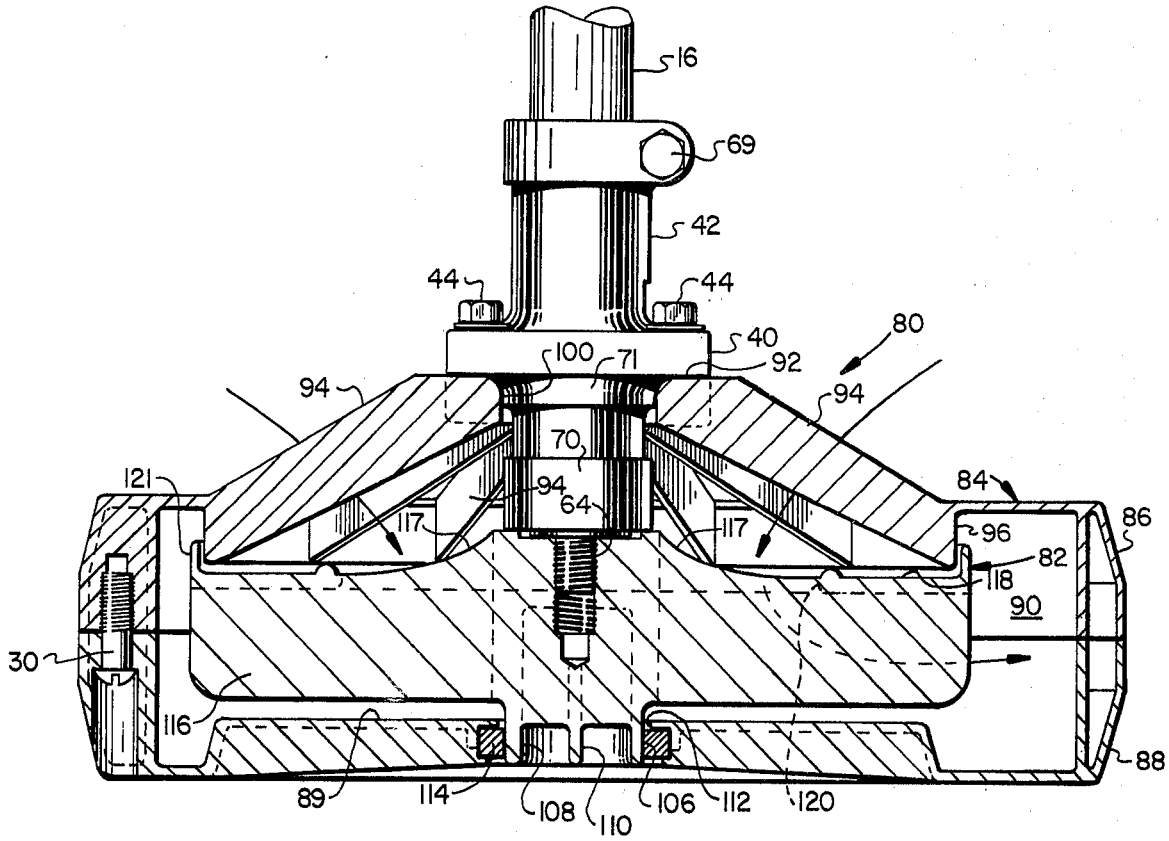
FIG. 6 is a section view of an alternate embodiment of the air blower unit taken generally along the same line as the view of FIG. 3.
Figure 7:
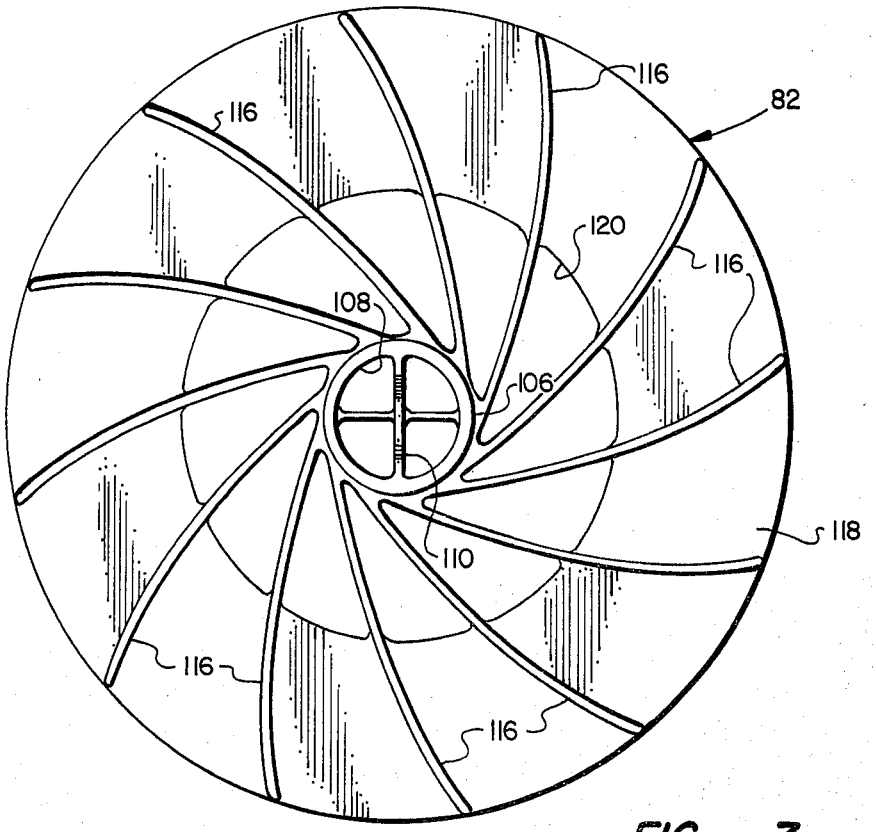
FIG. 7 is a plan view of one side of the impeller of the blower unit illustrated in FIG. 6.

Referring now to FIGS. 6 and 7 of the drawings, in alternate embodiment of the blower unit of the present invention is illustrated and generally designated by the numeral 80. The blower unit 80 includes a centrifugal impeller 82 adapted to be threadedly engaged with the distal end of the drive shaft 64 in generally the same manner as the impeller 20 of the blower unit 10. The blower unit 80 also includes a casing 84 formed of separable casing parts 86 and 88 which are provided with a discharge opening, not shown, similar to the configuration of the discharge nozzle 23 for the casing 22. The casing parts 86 and 88 are adapted to form an interior discharge flow passage 90 for receiving a high velocity air flow stream from the impeller 82 to discharge same through the aforementioned outlet. The casing part 86 is also provided with an upwardly facing mounting pad 92 which is integral with the casing part and is supported by a plurality of radially projecting integral webs 94 which are spaced apart to form an air inlet opening for air flow entering the interior of the casing part 86. The webs 94 are also each contiguous at one end with an axially projecting cylindrical rim 96 forming an inner wall portion of the casing part 86 and defining part of the inlet opening as well as the flow passage 90. The webs 94 also comprise inlet guide vanes for directing the inflowing air stream to the impeller 82 in a generally axial direction with respect to the axis of rotation of the impeller. The casing part 86 is also provided with a central opening 100 in the mounting pad 92 for receiving the pilot portion 71 of the housing 42. The mounting pad 92 is adapted to receive the fasteners 44 in threaded engagement therewith for securing the casing 84 to the bearing housing 42.

The impeller 82 is also provided with an axially projecting hub 106 having a central recess 108 and a transverse web 110 extending across the recess and forming means for gripping the impeller 82 to connect and disconnect same with respect to the drive shaft 64. The hub 106 extends through a central opening 112 in the casing part 88 in which is disposed a flexible stationary dust seal 114. The configuration of the impeller 82 is such that a low pressure condition exists in the vicinity of the hub 106 during operation of the blower unit which would permit ingestion of dirt and debris into the impeller through the clearance between the hub 106 and the opening provided in the wall 89 of the casing part 88 without the provision of the dust seal 114.

The impeller 82 is also of the type provided with an open side. However, the impeller 82, which is provided with forward curved radially extending blades 116, is also provided with a blade support plate 118 facing the webs 94 and having a central inner peripheral opening 120 providing the air inlet opening into the impeller. The support plate 118 is provided with an outer peripheral axially extending flange 121 which extends in surrounding relationship to the axially extending inner wall portion 96 of the casing part 86. The flange 121 is dimensioned to be closely spaced from the wall 96 to minimize leakage flow from the passage 20 back into the inlet area for the impeller 82. The blades 116 of the impeller 82 also include somewhat axially projecting inlet or inducer portions 117 which project axially upward beyond the plane of the integral support plate 118.

As will be appreciated from the foregoing description, the blower unit 80 may also be preassembled into a unit comprising the housing parts 86 and 88 and the impeller 82 disposed therein. These parts, forming the entire blower unit, may then be mounted on the bearing housing 42 by threading the impeller 82 onto the distal end of the drive shaft 64 without requiring disassembly of the blower unit itself. The assembled combination of the blower unit 80 and the bearing housing 42 may, of course, also be preassembled and connected as a unit to the support tube 14 in the same manner as the embodiment of the blower unit described hereinbefore. The casing parts 86 and 88 may also be disassembled by removing a plurality of threaded fasteners 30, one shown in FIG. 6 for replacement or repair of the impeller 82, if needed.

Those skilled in the art will appreciate that various substitutions and modifications may be made to the embodiments of the invention disclosed herein without departing from the scope of the invention as defined in the appended claims.

What is claimed is:

1. An air blower for attachment to a portable power supply unit including a prime mover, a support, and a drive shaft mounted on said support, said air blower comprising:

a casing including first and second separable parts, a generally upward facing air inlet opening formed in a top wall of said first part of said casing, a bottom wall formed on said second part of said casing spaced from said top wall and defining an air flow passage between said walls, and a generally horizontal air discharge nozzle in said casing in communication with said passage for directing a relatively high velocity air stream away from said casing;

a mounting surface formed on said casing for removably mounting said casing on said support;

an impeller disposed within said casing, said impeller having a hub including means for removably mounting said impeller on said drive shaft in driven engagement with said drive shaft; and means on said impeller for connecting said impeller to said drive shaft and removing said impeller from said drive shaft without disassembling said casing.

2. The air blower set forth in claim 1 wherein:

said drive shaft includes a threaded portion formed on a distal end of said drive shaft, said hub portion of said impeller includes a complementary threaded portion engageable with said threaded portion on said drive shaft; and said bottom wall of said casing includes an opening therein for providing access to said means on said impeller whereby said impeller may be rotated to connect or disconnect said impeller with respect to said drive shaft.

3. The air blower set forth in claim 1 wherein:

said means on said impeller includes a portion of said hub extending into said opening in said bottom wall.

4. The air blower set forth in claim 3 together with:

annular seal means disposed in a recess in said bottom wall at said opening in said bottom wall and surrounding said portion of said hub to substantially prevent the inflow of air into the interior of said casing through said opening in said bottom wall.

5. The air blower set forth in claim 3 wherein:

said portion of said hub includes an axially extending recess therein including a web portion extending across said recess and engageable for rotating said impeller.

6. The air blower set forth in claim 1 or 4 wherein:

said impeller includes a plurality of equally spaced apart blades extending generally radially outwardly from said hub, an integral support plate comprising a cylindrical disk supporting at least a portion of one side of each of said blades, the sides opposite said one side of said blades being disposed adjacent to an inner surface of said bottom wall, and an air inlet opening in said impeller delimited by a peripheral edge of said support plate.

7. The air blower set forth in claim 3 wherein:

said impeller includes a plurality of equally spaced apart blades extending generally radially outwardly from said hub, an integral support plate comprising a cylindrical disk supporting at least a portion of one side of each of said blades, the sides opposite said one side of said blades being disposed adjacent to an inner surface of said top wall, and said portion of said hub extends from said support plate on the side thereof opposite said blades.

8. The air blower set forth in claim 7 wherein:

said one part of said casing includes an axially extending rim forming a portion of said top wall, and said impeller includes an axially extending flange portion disposed in close fitting surrounding relationship to said rim.

9. The air blower set forth in claim 1 wherein:

said mounting surface on said casing is formed on an upwardly facing pad formed on said first part of said casing, said pad being supported by a plurality of spaced apart radially extending webs extending from said pad to said top wall of said first part of said casing and forming therebetween said air inlet opening.

10. The air blower set forth in claim 9 wherein:

said support includes a bearing housing including a mounting flange, and a pilot portion extending from said flange and projecting through a pilot bore formed in said pad, and said distal end of said drive shaft extends from said pilot portion of said bearing housing.

11. A portable air blower comprising in combination:

a power unit including a power takeoff shaft;

an elongated support tube connected to said power unit at one end and including means at the opposite end for mounting an air blower unit thereon, said support tube including a curved portion forming a generally vertically extending distal end when said air blower is disposed in a normal working position for cleaning a substantially horizontal surface;

spaced apart handle means formed on said power unit and said support tube, respectively, for manipulating said air blower;

an elongated drive shaft rotatably mounted in said support tube, a bearing housing mounted on said distal end of said support tube, and a rigid portion of said drive shaft mounted in said bearing housing;

said air blower unit comprising a casing having a generally upward facing air inlet opening, an air discharge nozzle formed in said casing including an opening for directing a stream of high velocity air generally horizontally from said casing, and an impeller disposed in said casing and drivably connected to said rigid portion of said drive shaft, said casing including an upwardly facing pad formed on a first part of said casing, said pad being supported by a plurality of spaced apart radially extending webs extending from said pad to a top wall of said first part and forming therebetween said air inlet opening; and means on said bearing housing and said casing for releasably connecting said air blower unit to said bearing housing.

12. The air blower set forth in claim 11 wherein:

said bearing housing includes a mounting flange and a pilot portion extending from said flange and projecting through a pilot bore formed in said pad, and said rigid portion of said drive shaft extends from said pilot portion of said bearing housing.

13. A portable air blower comprising in combination:

a power unit including a power takeoff shaft;

an elongated support tube connected to said power unit at one end and including means at the opposite end for mounting an air blower unit thereon, said support tube including a curved portion forming a generally vertically extending distal end when said air blower is disposed in a normal working position for cleaning a substantially horizontal surface;

spaced apart handle means formed on said power unit and said support tube, respectively, for manipulating said air blower;

an elongated drive shaft rotatably mounted in said support tube;

said air blower unit comprising a casing having a generally upward facing air inlet opening, an air discharge nozzle formed in said casing including an opening for directing a stream of high velocity air generally horizontally from said casing, and an impeller disposed in said casing and drivably connected to said drive shaft, said drive shaft including a threaded portion formed on the distal end thereof, said impeller including a hub having complementary threads engageable with said threaded portion on said drive shaft; and a bottom wall of said casing having an opening therein for providing access to means on said impeller whereby said impeller may be rotated to connect or disconnect said impeller with respect to said drive shaft without removing said impeller from said casing.

14. A portable air blower comprising in combination:

a power unit;

an elongated support tube connected to said power unit at one end and including means at the opposite end for mounting an air blower unit thereon;

spaced apart handle means formed on said power unit and said support tube, respectively, for manipulating said air blower;

an elongated drive shaft rotatably mounted in said support tube and adapted to interconnect said power unit with said air blower unit;

said air blower unit comprising a casing having a generally upward facing air inlet opening, an air discharge nozzle formed in said casing including an opening for directing a stream of high velocity air generally horizontally from said casing, and an impeller disposed in said casing and drivably connected to said drive shaft, said casing including a top wall including generally centrally disposed mounting pad means and a plurality of spaced apart radially extending webs extending from said pad means to another portion of said top wall and forming therebetween said air inlet opening; and means on said support tube and said pad means for connecting said air blower unit to said support tube.

15. A portable air blower comprising in combination:

a power unit;

an elongated support tube connected to said power unit at one end and including means at the opposite end for mounting an air blower unit thereon;

an elongated drive shaft assembly rotatably mounted in said support tube;

said air blower unit comprising a casing having an air inlet opening, an air discharge nozzle formed in said casing including an opening for directing a stream of high velocity air generally horizontally from said casing, and an impeller disposed in said casing and drivably connected to said drive shaft assembly, said drive shaft assembly including a threaded portion formed on one end, said impeller including a hub having complementary threads engageable with said threaded portion; and a bottom wall of said casing having an opening therein providing access to means on said impeller for rotating said impeller to connect or disconnect said impeller with respect to said drive shaft without removing said impeller from said casing.

16. An air blower unit for attachment to a portable power supply unit including a prime mover, an elongated support tube, and a drive shaft mounted in said support tube, said air blower unit comprising:

a casing including a top wall having a generally upward facing air inlet opening formed therein, a bottom wall of said casing spaced from said top wall and defining an air flow passage between said walls, and a generally horizontal air discharge nozzle in said casing in communication with said passage for directing a relatively high velocity air stream away from said casing;

means on said casing for removably mounting said air blower unit on said support tube;

an impeller disposed within said casing, said impeller having a hub including means for removably mounting said impeller on said drive shaft in driven engagement with said drive shaft; and means on said impeller for connecting said impeller to said drive shaft and removing said impeller from said drive shaft without disassembling said casing.

* * * * *